US005372481A

United States Patent [19]

Boyd

[11] Patent Number: 5,372,481

[45] Date of Patent: Dec. 13, 1994

[54] CERAMIC BLADE ATTACHMENT SYSTEM

[75] Inventor: Gary L. Boyd, Alpine, Calif.

[73] Assignee: Solar Turbine Incorporated, San Diego, Calif.

[21] Appl. No.: 159,093

[22] Filed: Nov. 29, 1993

[51] Int. Cl.[5] ..... F01D 5/30

[52] U.S. Cl. ..... 416/220 R; 416/219 R

[58] Field of Search ..... 416/219 R, 220 R, 248

[56] References Cited

U.S. PATENT DOCUMENTS

| | | | |
|---|---|---|---|
| 2,430,185 | 11/1947 | Prescott | 416/220 R |
| 2,651,494 | 9/1953 | Persson | 416/220 R |
| 3,014,695 | 12/1961 | Rankin et al. | 416/220 R |

FOREIGN PATENT DOCUMENTS

| | | | |
|---|---|---|---|
| 83607 | 5/1982 | Japan | 416/220 R |
| 980656 | 1/1965 | United Kingdom | 416/220 R |

*Primary Examiner*—Edward K. Look
*Assistant Examiner*—James A. Larson
*Attorney, Agent, or Firm*—Larry G. Cain

[57] ABSTRACT

A turbine blade having a preestablished rate of thermal expansion is attached to a turbine wheel having a preestablished rate of thermal expansion being greater than the preestablished rate of thermal expansion of the turbine blade. The turbine blade has a root portion having a pair of recessed portions thereon. The turbine wheel includes a plurality of openings in which the turbine blade is positioned. Each of the openings have a pair of grooves therein in which are positioned a pair of pins having a generally rectangular cross-section and a reaction surface thereon. A pair of cylindrical rollers interposed respective ones of the pair of reaction surfaces and the pair of recessed portions. The attachment system or turbine assembly provides an economical, reliable and effective attachment of a component having a preestablished rate of thermal expansion to a component having a greater preestablished rate of thermal expansion.

14 Claims, 3 Drawing Sheets

CERAMIC BLADE ATTACHMENT SYSTEM

The Government of the United States of America has rights in this invention pursuant to Contract No. DE-AC02-92CE40960 awarded by the U.S. Department of Energy.

DESCRIPTION

1. Technical Field

This invention relates generally to a gas turbine engine and more particularly to a turbine wheel assembly and the joint between a ceramic blade and a turbine wheel.

2. Background Art

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of moving blades mounted on a turbine disc. The nozzle guide vanes are aerodynamically designed to direct incoming gas from the combustion stage onto the turbine blades and thereby transfer kinetic energy to the blades.

The gases typically entering the turbine have an entry temperature from 850 degrees to at least 1200 degrees Fahrenheit. Since the efficiency and work output of the turbine engine are related to the entry temperature of the incoming gases, there is a trend in gas turbine engine technology to increase the gas temperature. A consequence of this is that the materials of which the blades and vanes are made assume ever-increasing importance with a view to resisting the effects of elevated temperature.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

However, if the nozzle guide vanes and/or blades are made of ceramic, which have a different chemical composition, physical property and coefficient of thermal expansion to that of a metal supporting structure, then undesirable stresses, a portion of which are thermal stresses, will be set up between the nozzle guide vanes and/or blades and their supports when the engine is operating. Such undesirable thermal stresses cannot adequately be contained by cooling.

Furthermore, conventional joints between blades and discs have typically used a fir tree attachment, or root design. Historically, a dovetail root design has been used with a ceramic blade in which a metallic compliant layer of material is used between the highly stressed ceramic blade root and the metallic turbine disc to accommodate the relative movement, sliding friction, that occurs. The sliding friction between the ceramic blade and the metallic disc creates a contact tensile stress on the ceramic that degrades the surface. This degradation in the surface of the ceramic occurs in a tensile stress zone of the blade root, therefore, when a surface flaw is generated in the ceramic of critical size, the blade root will fail catastrophically.

The present invention is directed to overcome one or more of the problems as set forth above.

DISCLOSURE OF THE INVENTION

In one aspect of the invention, a turbine assembly is comprised of a turbine wheel having a plurality of openings therein and a plurality of blades positioned in respective ones of the plurality of openings. Each of the plurality of openings has a groove therein and a pin slidably positioned therein and the pin has a reaction surface thereon. Each of the plurality of blades has a root portion confined within a corresponding opening and the root portion has a recessed portion. A cylindrical pin is interposed the recessed portion and the reaction surface.

BEST MODE FOR CARRYING OUT THE INVENTION

Figure 1:
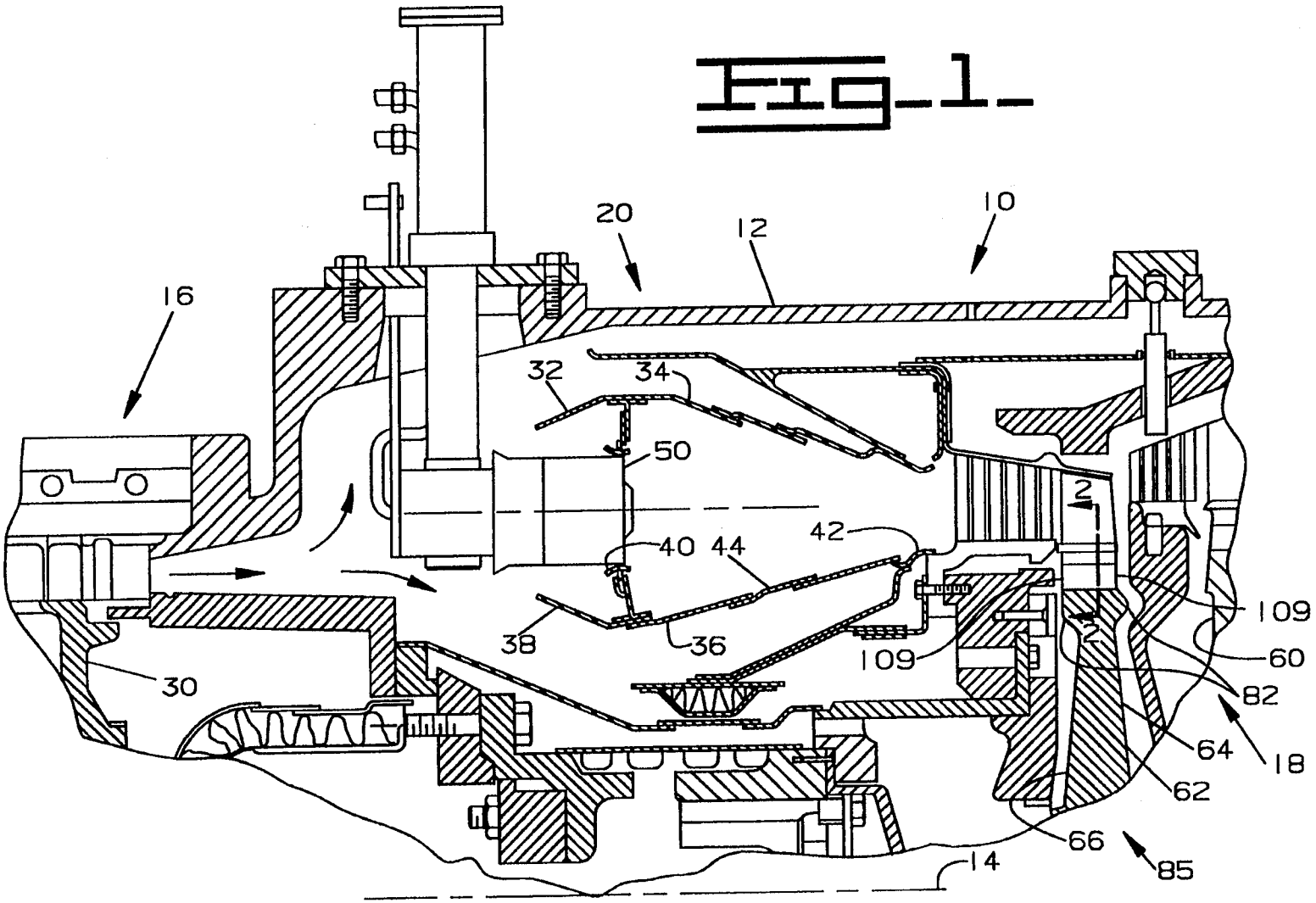
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the 10 compressor section 16, which in this application includes an axial staged compressor 30 or, as an alternative, a radial compressor or any source for producing compressed air, causes a flow of compressed air which has at least a part thereof communicated to the combustor section 20. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

Figure 2:
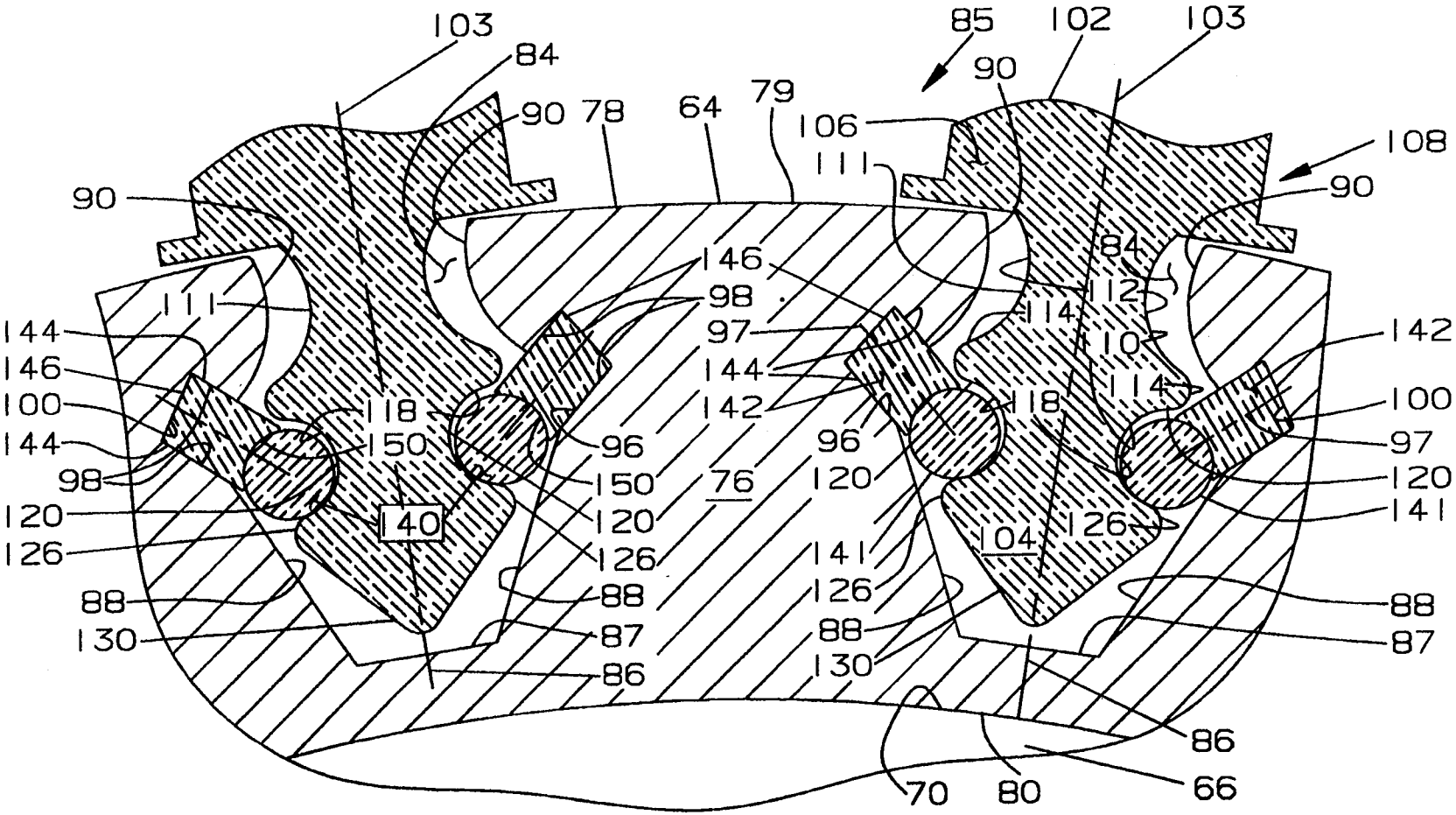
FIG. 2 is an enlarged sectional view of a joint between a ceramic blade and a disc taken along line 2—2.

The turbine section 18 includes a power turbine 60 having an output shaft, not shown, connected thereto for driving an accessory component such as a generator. Another portion of the turbine section 18 includes a gas producer turbine 62 connected in driving relationship to the compressor section 16. As best shown in FIG. 2, the gas producer turbine 62 includes a turbine assembly 64 being rotationally positioned about the central axis 14. The turbine assembly 64 includes a disc 66 being formed within an outer extremity 70. The disc 66 has a preestablished thickness or width which is defined between a first face and a second face. Attached to the outer extremity 70 of the disc 66 is a flange 76 having a generally rectangular cross-section, a preestablished rate of thermal expansion, an outer portion 78 defining an outer peripheral surface 79, an inner portion 80 and a pair of end walls 82 forming a preestablished width, as best shown in FIG. 1. The flange 76, in this application is made of an alloy steel. Positioned in the flange 76 are a plurality of evenly spaced openings 84 having a generally arrow shaped configuration. The disc 66 and the flange 76 form a turbine wheel 85. Each of the openings 84 includes a central planer axis 86 radially extending through and centered within the opening 84, and a generally flat bottom portion 87 being spaced inwardly a preestablished radial distance from the outer portion 78. A pair of sides 88 extend generally radially from the bottom portion 87 at an obtuse angle thereto, which could be at an angle of between 105 and 135 degrees. In this application, the acute angle is 120 degrees. Each of the openings 84 have a pair of arcuate portions 90 extending from the outer portion 78 inwardly toward a corresponding one of the pair of sides 88. Interposed corresponding ones of the pair of arcuate portions 90 and the pair of sides 88 is a groove 96 having a generally central planer axis 97 which is at about a 45 degree angle to the central planer axis 86 of the opening 84. The groove 96 extends linearly between the pair of end walls 82. In this application, the groove 96 has a generally "U" shaped profile including a pair of side walls 98 one of each intersecting the corresponding one of the pair of sides 88 and the arcuate portions 90 respectively and a base 100.

Positioned within each of the openings 84 is a blade 102 including a central axis 103 radially extending through and centered in the blade 102 and generally aligned with the central planer axis 86 of the opening, a root portion 104 confined within the opening 84, a base portion 106 extending radially from the root portion 104 and a blade portion 108 radially extending from the base portion 106. The blade 102 is retained within the opening 84 between the pair of end walls 82 by a retainer means of conventional design, not shown. In this application, the blade 102 is made of a ceramic material, such as silicon nitride or silicon carbide, and has a preestablished rate of thermal expansion which is less than the preestablished rate of thermal expansion of the flange 76. The root portion 104 includes a pair of end walls 109, as best shown in FIG. 1, being generally flat and a pair of grooved side walls 111 extending between the end walls 109 toward the base portion 106. The grooved walls 111 have a transition portion 112 blendingly extending generally radially inward from the base portion 106. The transition portion 112 generally mirrors, but spaced therefrom, the arcuate portions 90 of the opening 84. A first projection portion 114 is provided radially inward of the transition portion 112. Extending from the first projection portion 114 is a recessed portion 118 having a preestablished radiused contoured portion or reaction surface 120 having a preestablished surface finish blendingly contoured to the first projection portion 114. A second projection portion 126 extends radially inward of the recessed portion 118. An end portion 130 extends radially inward of the second projection portion 126.

The blade 102 is retained in the opening 84 by a pair of retainers or members or rollers or balls 140. In this application, a pair of generally cylindrical rollers are positioned within the recessed portion 118 and extending substantially,the width of the flange 76 of the turbine wheel 85. The cylindrical rollers 140 have a preestablished radius forming a generally arcuate reaction surface 141 having a preestablished surface finish. A pair of pins 142 having a generally rectangular cross-section further retain the blade 102 within the opening 84. Each pin 142 has a pair of sides 144 which slidably engage the pair of side walls 98 of the groove 96 and a base 146 which contacts the base 100 of the groove 96. The side opposite the base 146 forms a reaction surface 150 which in this application has a concave arcuate configuration and is formed by a radius. As an alternative, the reaction surface 150 could be flat. The reaction surface 150 has a preestablished radius which is slightly larger than the radius of the cylindrical rollers 140 and has a surface finish generally equivalent to the surface finish of the cylindrical rollers 140. In this application, the pair of cylindrical rollers 140 and the pair pins 142 are made of a ceramic material, such as silicon nitride or silicon carbide, having a preestablished rate of thermal expansion which is substantially equal to the rate of thermal expansion of the blade 102. As an alternative, the preestablished radius of the concave arcuate surface 150 and the preestablished radius of the contour portion could be equal or slightly different without changing the essence of the invention. As a further alternative, the surface 150 could be generally flat eliminating the concave arcuate configuration. Furthermore, the preestablished radius of the cylindrical rollers 140 is less than the preestablished radius of the concave arcuate surface 150 and/or the contour portion 120.

Figure 3:
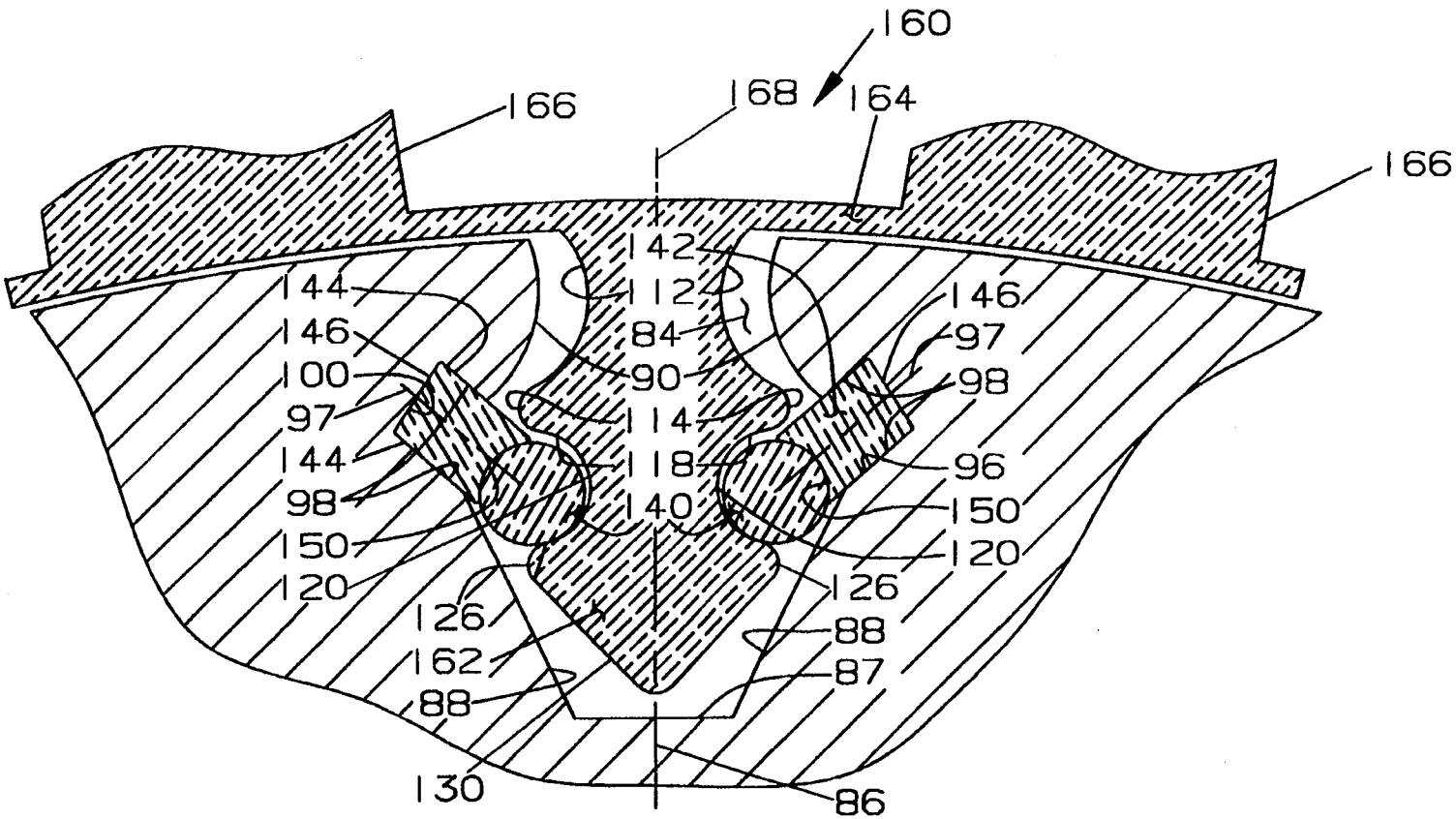
FIG. 3 is an enlarged sectional view of an alternative turbine blade construction embodying the present invention.

An alternative blade 160 configuration is shown in FIG. 3. The blade 160 includes a root portion 162 confined within the opening 84, a base portion 164 extending circumferentially along the outer portion 78 and is spaced therefrom. A pair of blade portions 166 radially extending from the base portion 164. The root portion 162 is identical to the root portion 104 of the blade 102. The root portion 162 has a central planer axis 168 radially extending through and centered in the root portion 162 and centered between the pair of blade portions 166. The base portion 164 is longer to accommodate the pair of blade portions 166. Thus, the number of openings 84 required in the turbine wheel 85 can be reduced. In this application, the blade 160 is made of a ceramic material, such as silicon nitride or silicon carbide, and has a preestablished rate of thermal expansion which is less than the preestablished rate of thermal expansion of the turbine wheel 85.

INDUSTRIAL APPLICABILITY

In use, the gas turbine engine 10 is started and allowed to warm up and is used in any suitable power application. As the demand for load or power is increased, the engine 10 output is increased by increasing the fuel and subsequent air resulting in the temperature within the engine 10 increasing. The components used to make up the turbine assembly 64, being of different materials and different rates of thermal expansion, grow at different rates and the forces resulting therefrom and acting thereon must structurally be compensated for it increase life and efficiency of the gas turbine engine. For example, as the turbine assembly 64 rotates, centrifugal forces cause the individual blades 102 to exert a force on the flange 76. The cylindrical surface 141 of the cylindrical rollers 140 rotates about the contoured portion 120 of the recessed portion 118 as the blade 102 moves. The cylindrical surface 141 of the cylindrical rollers 140 also rotates about the reaction surface 150 of the rectangular pin 142. Thus, the centrifugal forces transmitted by the blades 102 are in rolling contact between the flange 76 and the blade 102. The load is reacted through the ceramic blade, 102 into the ceramic cylindrical rollers 140, into the ceramic rectangular pin 142 and into the flange 76 and disc 66. The reaction surface 150 of the ceramic rectangular pin 142 is placed in a highly compressive load which does not allow a surface induced flaw to propagate and cause catastrophic failure of the ceramic rectangular pin 142. As the flange 76, which is made of a steel material, expands due to an increase in temperature, the functionality of the rolling contact is further utilized. For example, the relative geometry of the opening 84 will grow to a greater degree relative to the geometry of the blade 102, cylindrical rollers 140 and the rectangular pin 142 which are made of a ceramic material. Thus, the cylindrical surface 141 of the cylindrical rollers 140 rotates about the contoured portion 120 of the recessed portion 118 as the blade 102 moves. The cylindrical surface 141 of the cylindrical rollers 140 also rotates about the concave arcuate surface 150 of the rectangular pin 142. Thus, the centrifugal forces transmitted by the blades 102 are in rolling contact between the expanded flange 76 and opening 84, and the blade 102. Furthermore, the force of thermal growth add further compressive load to the cylindrical rollers 140 and the rectangular pin 142.

In view of the foregoing, it is readily apparent that the structure of the present invention provides an improved joint between the ceramic blade 102 or a component having a preestablished rate of thermal growth which is low and the turbine wheel 85 or a component having a preestablished rate of thermal growth which is much higher than the ceramic material. The structural arrangement of the cylindrical rollers 140 and mating reaction surface 150 and contoured portion 120 provides a rolling joint which reduces or eliminates surface induced flaws which may cause catastrophic failure of ceramic components.

Other aspects, objects and advantages of this invention can be obtained from a study of the drawings, the disclosure and the appended claims.

I claim:

1. A turbine assembly comprising:

a turbine wheel having a plurality of openings therein, each of said plurality of openings having a groove therein and a pin slidably positioned therein, said pin having a reaction surface thereon;

a plurality of blades positioned in respective ones of the plurality of openings, each of said plurality of blades having a root portion confined within a corresponding opening, said root portion having a recessed portion; and a generally cylindrical roller being interposed the recessed portion and the reaction surface.

2. The turbine assembly of claim 1 wherein said reaction surface has a concave arcuate configuration formed by a preestablished radius and said recessed portion has a preestablished radiused contour portion.

3. The turbine assembly of claim 2 wherein said preestablished radius of the reaction surface and the preestablished radiused contour portion have radii generally equal to each other.

4. The turbine assembly of claim 2 wherein said generally cylindrical roller has a preestablished radius which is less than the preestablished radius of the reaction surface.

5. The turbine assembly of claim 2 wherein said generally cylindrical roller has a preestablished radius which is less than the preestablished radius of the contour portion.

6. The turbine assembly of claim 1 wherein said turbine wheel has a preestablished width and said generally cylindrical roller has a length substantially equal to the width of the turbine wheel.

7. The turbine assembly of claim 1 wherein each of said plurality of openings includes a central planer axis and said groove has a generally central plane and an included angle between the central planer axis and the central plane of the groove is about 45 degrees.

8. The turbine assembly of claim 1 wherein said turbine wheel is made of a material having a preestablished rate of thermal expansion and said blade has a preestablished rate of thermal expansion which is less than the rate of thermal expansion of the turbine wheel.

9. The turbine assembly of claim 6 wherein said blade has a preestablished rate of thermal expansion and said pin has a preestablished rate of thermal expansion being substantially equal to the rate of thermal expansion of the blade.

10. The turbine assembly of claim 6 wherein said blade has a preestablished rate of thermal expansion and said cylindrical roller has a preestablished rate of thermal expansion being substantially equal to the rate of thermal expansion of the blade.

11. The turbine assembly of claim 1 wherein each of said plurality of openings includes a pair of grooves, a pair of pins slidably positioned within each of the grooves, a pair of recessed portions and a pair of cylindrical rollers interposed respective ones of the pair of pins and recessed portions.

12. A turbine assembly comprising:

a turbine wheel is made of a material having a preestablished rate of thermal expansion and defining an outer peripheral surface having a generally radial opening therein and defining an inwardly facing reaction surface in said opening;

a blade made of a material having a preestablished rate of thermal expansion and having a root portion generally positioned in the opening, said root portion defining a generally outwardly facing reaction surface thereon being in spaced generally opposed relation to the reaction surface in the opening;

a retainer being interposed the reaction surfaces of the turbine wheel and the blade, said retainer having a generally arcuate reaction surface thereon being in rolling relation to the reaction surface on the blade; and said blade has a preestablished rate of thermal expansion which is less than the rate of thermal expansion of the turbine wheel.

13. The turbine assembly of claim 12 wherein said generally arcuate surface on the retainer is in rolling relation to the reaction surface in the opening.

14. The turbine assembly of claim 12 wherein said retainer has a preestablished rate of thermal expansion being substantially equal to that of the blade.

* * * * *